US006339429B1

(12) United States Patent
Schug

(10) Patent No.: US 6,339,429 B1
(45) Date of Patent: Jan. 15, 2002

(54) DYNAMIC ART FORM DISPLAY APPARATUS

(75) Inventor: Klaus Schug, Fort Collins, CO (US)

(73) Assignee: MZMZ Technology Innovations LLC, Germantown, MD (US)

( * ) Notice: Subject to any disclaimer, the term of this patent is extended or adjusted under 35 U.S.C. 154(b) by 0 days.

(21) Appl. No.: 09/325,386

(22) Filed: Jun. 4, 1999

(51) Int. Cl.[7] ..... G09G 5/10
(52) U.S. Cl. ..... 345/589; 348/227; 348/602
(58) Field of Search ..... 345/2, 63, 77, 345/89, 102, 589, 204; 348/227, 602, 603

(56) References Cited

U.S. PATENT DOCUMENTS

| | | | | | |
|---|---|---|---|---|---|
| 3,977,112 | A | | 8/1976 | Breer, II | |
| 4,386,345 | A | * | 5/1983 | Narveson et al. | 345/22 |
| 4,760,389 | A | * | 7/1988 | Aoki et al. | 345/102 |
| 5,153,756 | A | * | 10/1992 | Ike | 349/116 |
| 5,488,434 | A | * | 1/1996 | Jung | 348/725 |
| 5,532,848 | A | * | 7/1996 | Beretta | 358/504 |
| 5,617,112 | A | * | 4/1997 | Yoshida et al. | 345/102 |
| 5,642,172 | A | * | 6/1997 | Yoon et al. | 348/602 |
| 5,747,938 | A | * | 5/1998 | Beard | 315/169.3 |
| 5,757,438 | A | * | 5/1998 | Yoon et al. | 348/603 |
| 5,760,760 | A | * | 6/1998 | Helms | 345/102 |
| 5,945,975 | A | * | 8/1999 | Lundrigan et al. | 345/133 |
| 6,008,727 | A | | 12/1999 | Want et al. | |
| 6,057,814 | A | | 5/2000 | Kalt | |
| 6,069,598 | A | * | 5/2000 | Hansen | 345/74 |
| 6,078,302 | A | * | 6/2000 | Suzuki | 345/77 |
| 6,081,073 | A | * | 6/2000 | Salam | 315/169.2 |

* cited by examiner

*Primary Examiner*—Bipin Shalwala
*Assistant Examiner*—Ricardo Osorio

(57) ABSTRACT

A dynamic art form display displays electronic and optical art, pictures and movies using various display alteration methods in conjunction with flat electronic and optical wall and hand-held, portable display devices. The display alteration methods include light phasing, image propagation, time of day synchronization and combinations thereof. Viewer, environmental and automated control of the display, including a programmable borders and frames, are provided. User controls come in a variety of options such as voice commands and push buttons, and may be completely hidden in the form of voice or touch screen input. Environmental inputs come in a number of forms including amount of light present (light phasing), human viewer proximity and noise level. Automated control comes in the form of programmed parameters such as time of day, image propagation, image propagation rate, display duration, display intensity, volume level and display selection. A wide spectrum of electronic and optical art form media input sources are accommodated, including removable media such as CD-ROM, DVD, digital cameras, memory flash cards and removable disks, and non removable media such as the Internet, other computer networks, modems, computers, satellites, cable television, pagers, and video phones. Power can be self contained, externally supplied and is managed and controlled through user selectable functions. This invention removes major restrictions from existing art, picture and movie displays and allows new art, picture and movie forms to be formed and displayed at a consumer product level.

57 Claims, 14 Drawing Sheets

| LIGHT PHASING AUTOMATED CONTROL TABLE | | | | | | |
|---|---|---|---|---|---|---|
| **Location/Event** | **Local** | **Tokyo** | **Berlin** | **New York** | | **etc.** |
| **sun rise** | 0555 | local + 1600 | local + 0800 | local + 0200 | • • • | local + xxxx |
| **mid morning** | 0915 | local + 1600 | local + 0800 | local + 0200 | • • • | local + xxxx |
| **high noon** | 1315 | local + 1600 | local + 0800 | local + 0200 | • • • | local + xxxx |
| **mid afternoon** | 1655 | local + 1600 | local + 0800 | local + 0200 | • • • | local + xxxx |
| **sun set** | 2035 | local + 1600 | local + 0800 | local + 0200 | • • • | local + xxxx |
| **moon rise** | 2135 | local + 1600 | local + 0800 | local + 0200 | • • • | local + xxxx |
| **moon set** | 0435 | local + 1600 | local + 0800 | local + 0200 | • • • | local + xxxx |
| **1/4 moon** | +21 days | local + 1600 | local + 0800 | local + 0200 | • • • | local + xxxx |
| **1/2 moon** | today | local + 1600 | local + 0800 | local + 0200 | • • • | local + xxxx |
| **3/4 moon** | + 7 days | local + 1600 | local + 0800 | local + 0200 | • • • | local + xxxx |
| **full moon** | + 14 days | local + 1600 | local + 0800 | local + 0200 | • • • | local + xxxx |

Figure 8.

DYNAMIC ART FORM DISPLAY APPARATUS

FIELD OF THE INVENTION

This invention relates to displaying art in various unique manners on a relatively flat electronic and optical display that is hung on a wall or on a hand-held, portable device. More particularly, the present invention relates to displaying a dynamic art form on a hang-on-the-wall or portable display device where the art changes over time according to controlled combinations of light phasing and image propagation.

BACKGROUND OF THE INVENTION

Electronic and optical display and electronic and optical art technologies have been increasing in capabilities and decreasing in cost. Electronic and optical display technology such as a liquid crystal displays (LCDs), field-emission displays (FEDs), and plasma display panels (PDPs) now provide the capability of displaying information on 20 inch or even larger screens that are approximately two inches in width and near 20 pounds in weight, while consuming only a few watts of electrical power.

In addition, large quantities of art are now available on extremely small physical media such as compact disk read-only-memory (CD-ROM), Digital Video Disk (DVD), memory flash cards and other removable or remotely accessible storage devices.

The two technologies by themselves, display and storage devices, are "dumb" technologies in that to date, they require a rather elaborate computer system with equally elaborate software programs in order to present art on an electronic and optical display. Even in the case of portable, notebook type computers, the hardware and software overhead of a general purpose computing environment precludes the use of such notebook computers as art displays on walls of homes.

Personal computer users can now flip through collections of images, but these programs are intended as screen savers and image catalogs. They provide only rudimentary control over the display. Much like someone flipping through a photo album, these programs flip through collections of images at a fixed rate. The user may change the fixed flip rate and build a collection of images to be presented.

Present day electronic image display programs require large systems and dedicated areas to display the images, (i.e., a computer, large cathode ray tube (CRT) display, keyboard and a desk, or a television with some sort of input box).

Moreover, present electronic and optical art, picture and movie displays do not integrate display and control hardware and software in a manner consistent with allowing people to hang a display on their wall that accepts popular art, picture and movie storage media as its input and provides the user with complete control over the display of their choice of art form.

Present day non-electronic and optical art form displays, such as pictures with frames, as well as electronic and optical displays, limit the display to one selection that never changes, as well as limit the framing to a one-time selection.

SUMMARY OF THE INVENTION

It is an object of the invention to address the above-noted disadvantages in conventional non-electronic and electronic art form displays.

It is another object of the invention to provide a dynamic art form display device that adapts the displayed art form using highly flexible environmental-sensor-controlled or time reference synchronized image adaptation techniques.

It is another object of the invention to provide a dynamic art form that can be hung on the wall or carried in one's pocket, that provides for light phasing, image propagation and time of day synchronized alterations of what is displayed via a variety of automated, environmental, user and sensor controls. The invention combines innovative display methods along with the size, weight and volume characteristics of hang-on-the-wall or portable personal displays. This new electronic and optical display invention enables new types of art displays, where the art does not remain fixed, as well as provide endless display selection and control over the display.

Art Display Modes

It is yet another object of the present invention to provide art, pictures and movies display where the art, pictures and movies can change over time according to light phasing, e.g., the lighting in the picture or art changing to match the light of day from sunrise to sunset to sunrise.

It is a further object of the present invention to provide art, pictures and movies display where the art, pictures and movies can change over time according to image propagation, e.g., a person continuing to come down a set of stairs in the picture during the course of a day.

Art Display Modes with Display Hardware Combinations

It is a further object of the present invention to provide a hang-on-the-wall and hand-held, portable electronic and optical art, picture and movie display where the art, pictures and movies can change over time according to light phasing.

It is a further object of the present invention to provide a hang-on-the-wall and hand-held, portable electronic and optical art, picture and movie display where the art, pictures and movies can change over time according to image propagation.

It is a firther object of the present invention to provide a hang-on-the-wall and hand-held, portable electronic and optical art, picture and movie display where the art, pictures and movies can change over time according to user, sensor and automated control methods such as time of day synchronization.

Art Display Control Modes and Other Features

Besides the above-listed novel art display modes and display mode hardware display combination features, the invention includes provisions for a variety of control, art input and power features.

Control features include using the following techniques to alter or affect what is displayed and how things are displayed: time of day synchronization (e.g., a scene or person that continues to progress or regress in time during the display period), viewer proximity, human voice, wireless (optical, infrared—IR and radio frequency—RF) signals, user programmable inputs such as keys and touch screen controls, and built-in automated control such as a predetermined display change rate interval.

Art input or input interfaces to the display modes and devices include: various electronic and optical media art sources (e.g., CD-ROM, DVD, memory flash cards and removable disks), modems, cameras, networks such as the Internet, personal computers, and various non-electronic media such as slide and negative film, Advanced Photo System (APS) film cartridges and paper art.

Power features include self contained power (e.g., batteries, solar power and fuel cells) as well as attachments for obtaining power for the display from an external power source such as an electrical wall plug.

The invention achieves these objects in part by providing an electronic and optical art form display with the following features:

1. Alteration of the display based on:
   a. Light phasing;
   b. Image propagation;
   c. Time of day synchronization and automated control;
   d. User inputs; and
   e. Environmental sensor inputs.
2. A hang-on-the-wall sized or portable, hand-held display with display alteration methods of:
   a. Light phasing;
   b. Image propagation;
   c. Time of day synchronization and automated control;
   d. User inputs; and
   e. Environmental sensor inputs.

In addition, users can insert or connect (physically or via IR and RF) new art, pictures and movies, decide the border and framing of the display, decide the type and rate of change the art, pictures and movie images will undergo, and decide a number of other display parameters such as display times and duration. Environmental inputs such as time of day, amount of light, human viewer proximity to the display and noise level can be used to trigger the light phasing, image propagation, time of day synchronization alteration of what is displayed without manual or user input. Automatic control such as fixed time intervals can also be used to trigger the unique methods of altering what is displayed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 8 shows a time of day to sunlight, moonlight and earth location light phasing values table that is utilized by the invention in the time of day synchronization art display method;

DETAILED DESCRIPTION OF THE INVENTION

The invention includes the displaying of electronic and optical art, pictures and movies using novel display alteration methods in conjunction with flat electronic and optical wall, and hand-held, portable display devices. The unique display alteration methods include light phasing, image propagation and combinations thereof controlled via a variety of user, sensor (environmental) and automated controls. Before describing the apparatus, these display alteration techniques will be discussed.

Light Phasing

Light phasing is defined herein as a method of altering the display of art or objects whereby the lighting of the object or objects depicted in the display is altered. Light phasing includes alterations in the (a) light angle (e.g., moving shadows as the sun moves East-West, or as light source moves within the image), (b) light source intensity (e.g., luminance change of the light source) and (c) light type (e.g., clear sky, partly cloudy, overcast, stormy, phases of the moon, spotlight, rotating light and emergency flashing light).

Figure 1A:
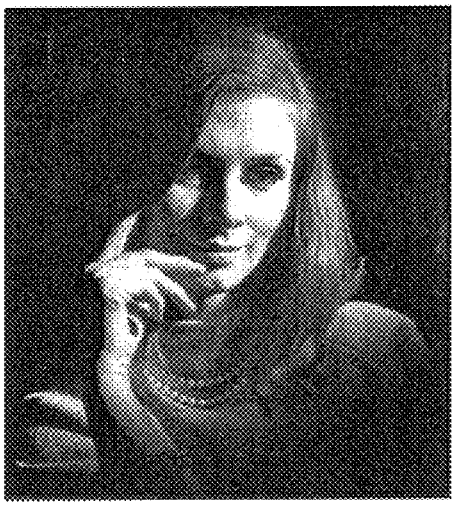
FIGS. 1*a–c* depict an example of the light phasing art display method according to the invention.
Figure 1B:
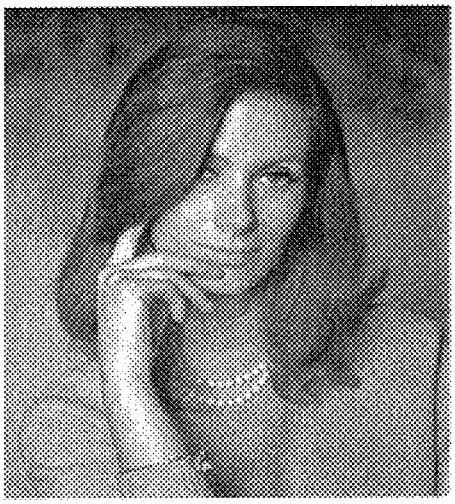
Figure 1C:
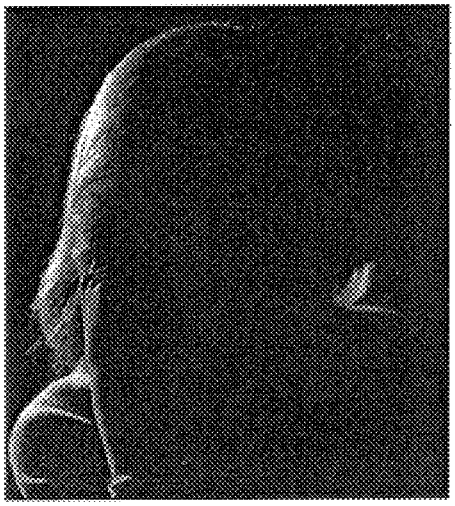

FIGS. 1*a–c* are illustrative examples of light phasing in which the lighting angle and intensity are changed. Particularly, FIG. 1*a* shows an image of a woman in which the light source origin is on the right. FIG. 1*b* shows the same woman with a higher intensity light source having an origin in front of the woman. FIG. 1*c* shows the same woman with a lower intensity light source having an origin to the left of the woman. In the sequence of images shown in FIGS. 1*a–c,* the light is phased from right to left. This light phasing can be used to simulate the movement of the sun (light source) over the course of a day with FIG. 1*a* being sunrise (from the east or right direction), FIG. 1*b* being full sunlight at noon and FIG. 1*c* being sunset (from the west or extreme left direction). The light-phased images of FIGS. 1*a–c* are preferably displayed in sequence. Various methods of controlling the display intervals and sequence are further discussed below.

Figure 3A:
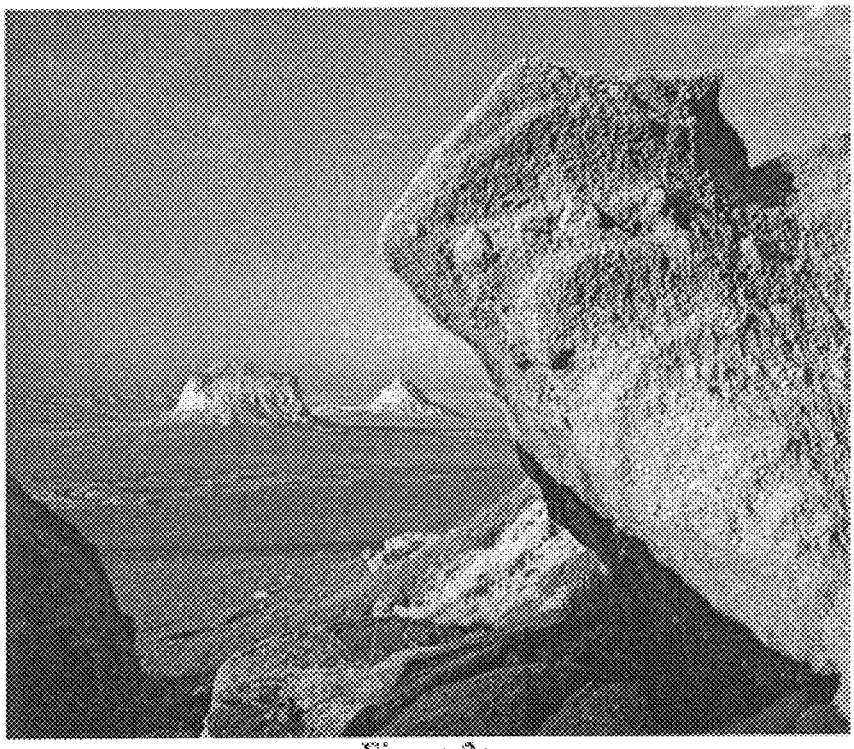
FIGS. 3*a–b* depict an example of the time of day synchronization art display method according to the invention.
Figure 3B:
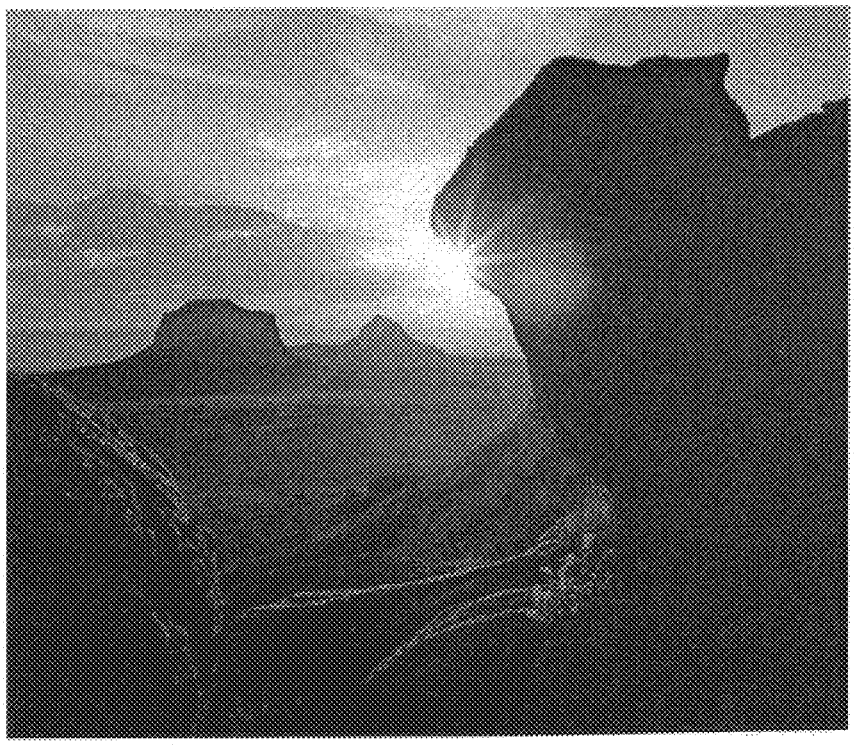

Changing the lighting of the object(s) displayed to match the light of day variation over the course of a day or days is a further application of light phasing. For example, the display of a picture of a residence is changed to show the residence in sunrise lighting from the East, then shadows and light are changed over the course of time to show the residence in mid-day light to sunset light to moonlight and back to sunrise lighting. FIGS. 3*a–b* illustrate changing the lighting of the displayed objects to match the light of day variation. More particularly, FIG. 3*a* shoes a desert scene in full or noon-time sunlight while FIG. 3*b* shows the same desert scene at sunset. These images can be displayed at times which match the local sunlight schedule. Preferably, the images of FIGS. 3*a–b* would be supplemented with other lighting variations such as the light and shadows of sunrise, morning, early evening and night (moonlight).

The light phasing of art or objects in a display can also include numerous variations of lighting, including lightning storm or overcast lighting, emergency vehicle lighting (flashing or rotating colored lights), bright moon light, no moon light, spotlight on and off, rotating lighting, lighting from one side then another, etc. Another example of light phasing is a scene of a house which may be depicted in regular sunlight at one instant and then depicted in the lighting of a thunder storm's lightning at the next instant.

Altering the lighting of a displayed image such as a building or person depending upon the angle or distance of the viewer to the display is another example of light phasing.

The light phasing can be real-time, meaning it would take 12 hours or so to go from sunrise to sunset lighting. The light phasing timing can also be faster or slower than real-time, e.g., going from sunrise to sunset lighting in a matter of minutes. The timing of the light variations are preferably independent of the light phasing technique employed.

Image Propagation

Image propagation is defined herein as methods of altering the display of art or objects whereby the (a) position, (b) size, (c) shape, (d) age, (e) rotation angle or (f) other physical characteristic(s) of an object or objects depicted in the display are altered from one display time of the object(s) to the next display time of the object(s). Not all objects are altered and at least some part of the display is preferably unchanged. In other words, one or more of the objects in a display are altered. The concept is to recognize the altered object(s) as being the same object(s) from one display time to the next display time with the object(s) age, position, color, size, or other physical characteristic being propagated or altered in some manner. Altering only the lighting of the object(s) displayed is considered light phasing, as discussed in the paragraph above, and is not within the definition of image propagation herein.

Figure 2A:
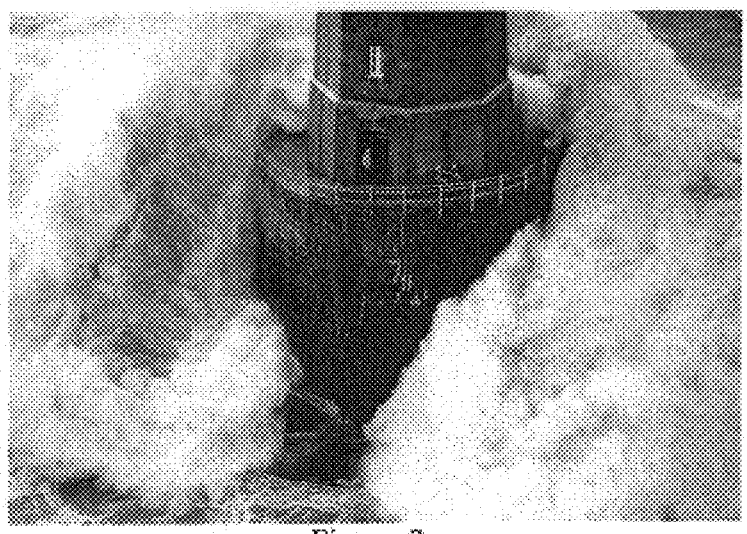
FIGS. 2*a–k* depict examples of the image propagation art display method according to the invention.
Figure 2B:
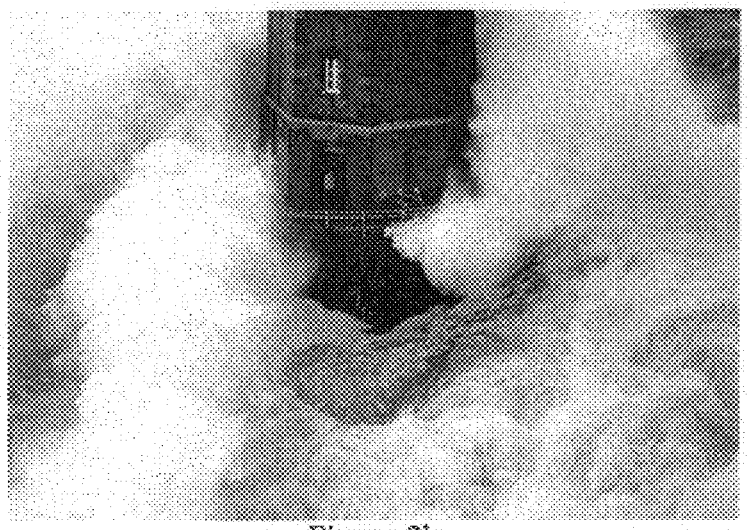
Figure 2C:
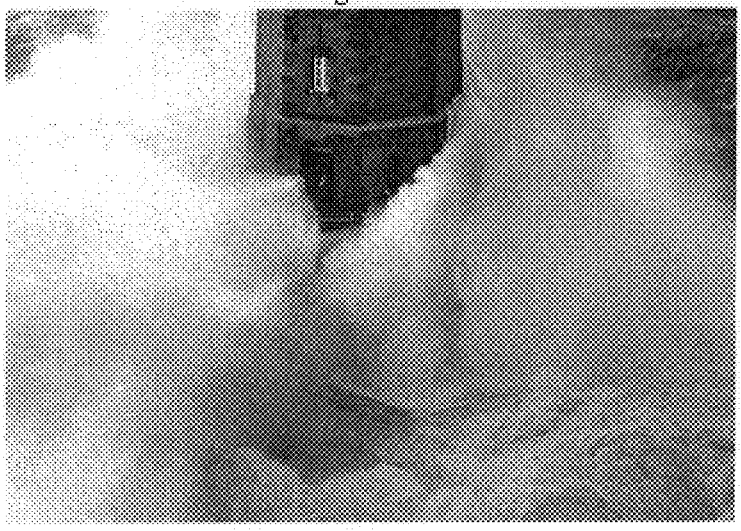

FIGS. 2*a–c* illustrate an example of image propagation. FIGS. 2*a–c* are a sequence of images in which an ocean wave propagates. The propagated object (ocean wave) washes over a non-propagated object (the lighthouse) in this sequence. In other words, an ocean wave is propagated around a lighthouse until the wave engulfs the entire structure.

Another example of image propagation is a display of a woman at the top of a staircase that is propagated by moving the woman: the woman continues to come down the staircase from one display to the next. The staircase and background are not altered, but the position of the woman continues to be propagated down the stairs. Another example is a person climbing up a mountain where the person is depicted higher and higher up the mountain from display to display. Other examples of image propagation include children growing up and the aerial appearance of towns changing over the course of the display time. The rise and fall of the Roman Empire depicted in a series of propagated images is yet another example of image propagation. Depicting the construction of a high rise building from the ground up is another example of image propagation. Changing the display of the image of a building or person by presenting different viewing angles or sizes are further examples of image propagation.

Figure 2D:
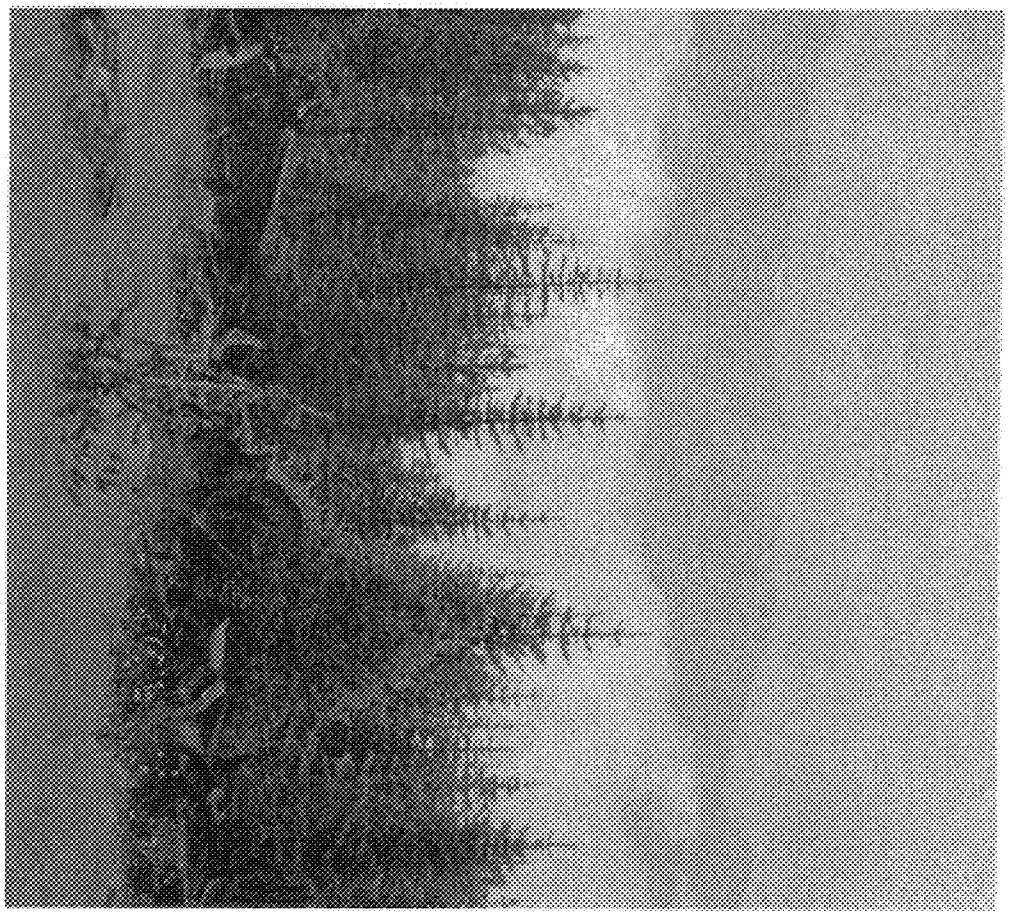
Figure 2E:
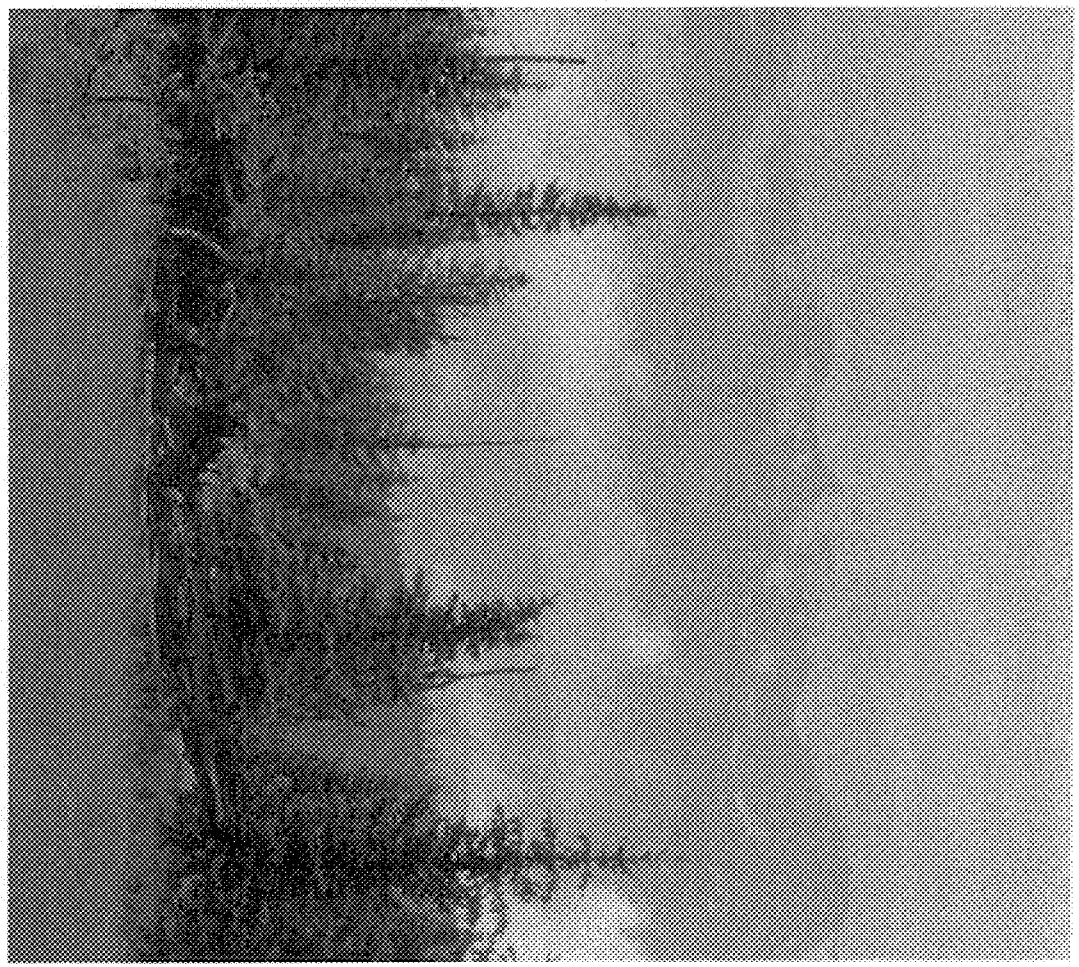
Figure 2F:
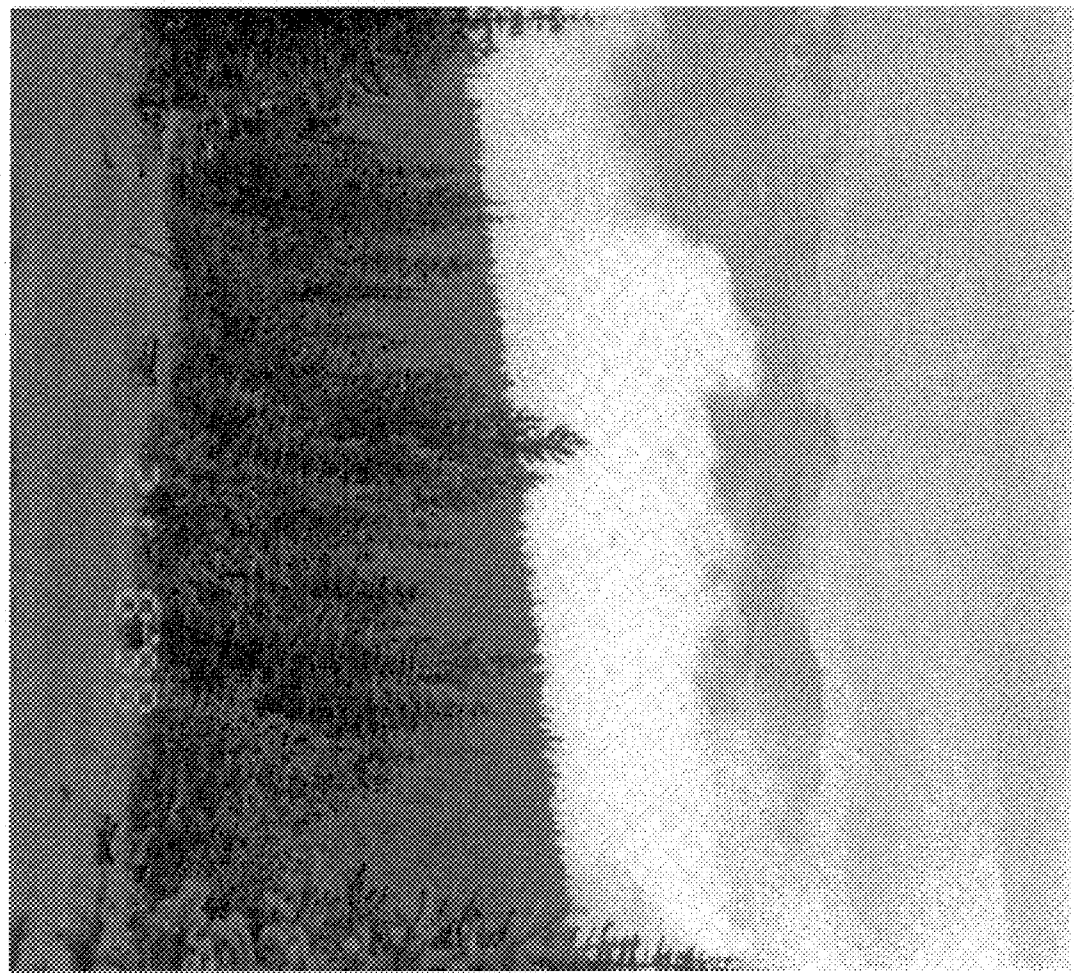

Other physical characteristics that can be altered for image propagation include the viewpoint and relative size of objects in the display. FIGS. 2*d–f* illustrate image propagation of the viewpoint via panning of the display object(s).

Figure 2G:
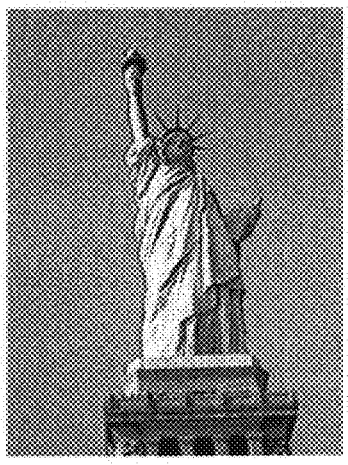
Figure 2H:
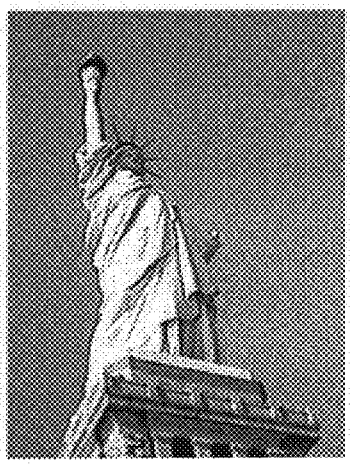
Figure 2I:
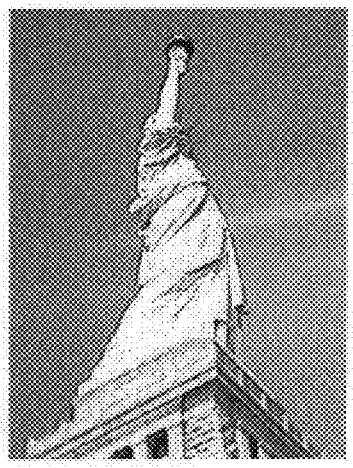
Figure 2J:
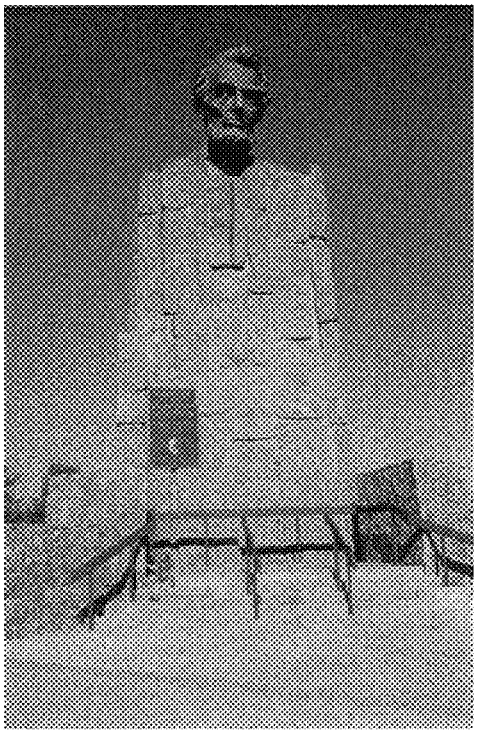
Figure 2K:
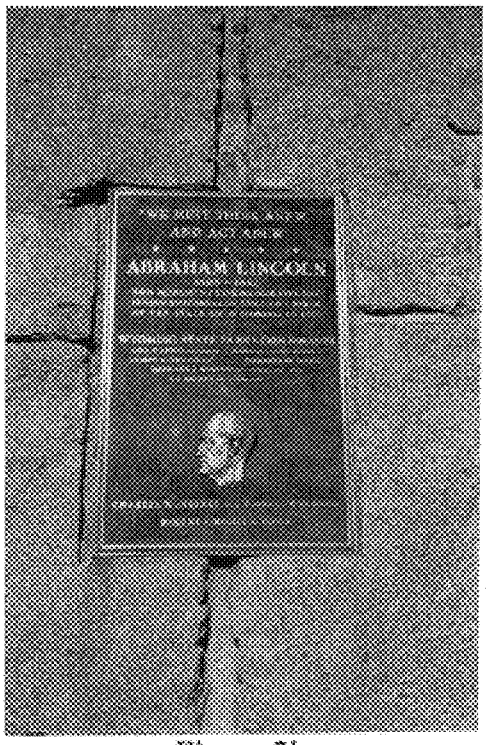

FIGS. 2*g–i* illustrate image propagation of the viewpoint via rotating an object or image. Panning and rotating may encompass the entire possible range, e.g., a 360 degree view of an object, objects or image. FIGS. 2*j–k* illustrate image propagation by altering the relative size characteristic (zooming) of objects or an image.

Methods of Performing Light Phasing and Image Propagation

Figure 6A:
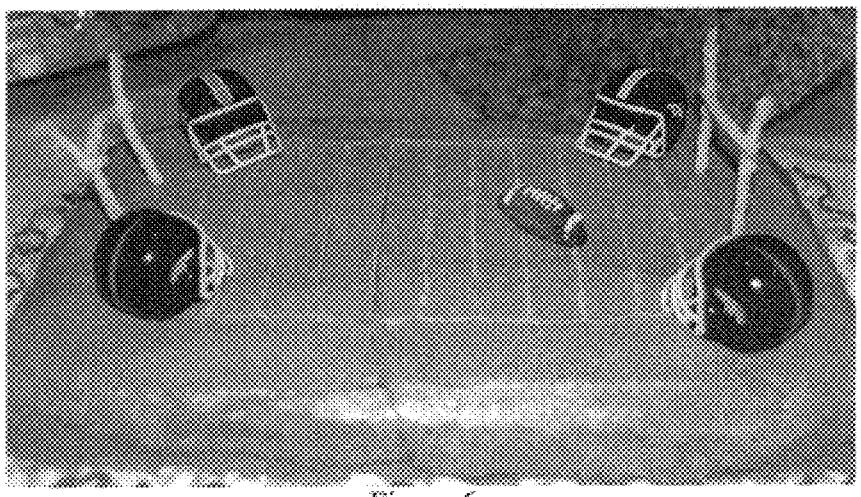
FIGS. 6*a–c* depict a foreground image (football) propagated within a background image (cake) which is another example of the inventive image propagation art display method.
Figure 6B:
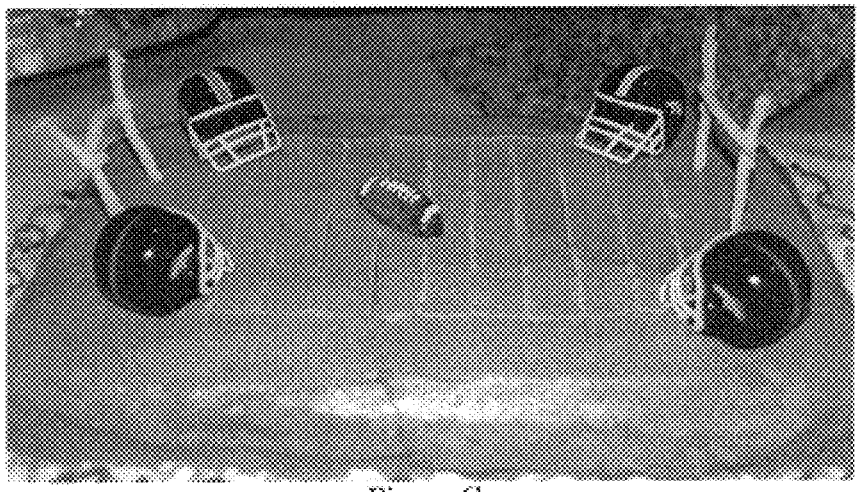
Figure 6C:
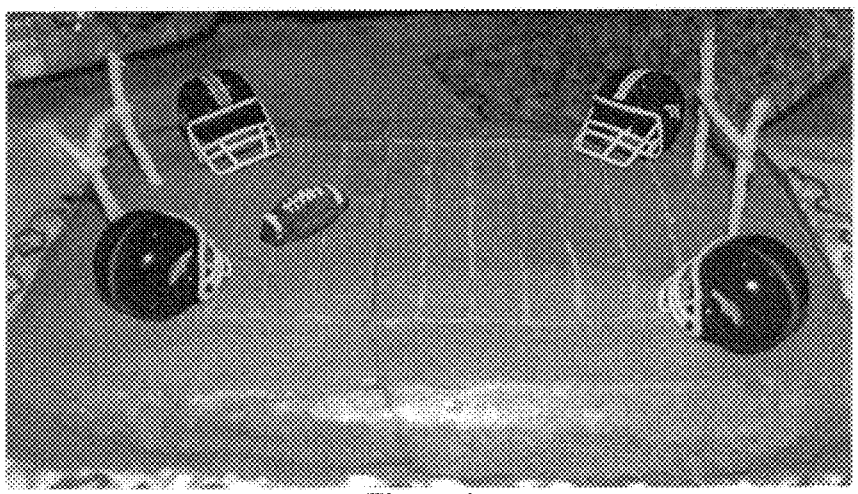
Figure 7A:
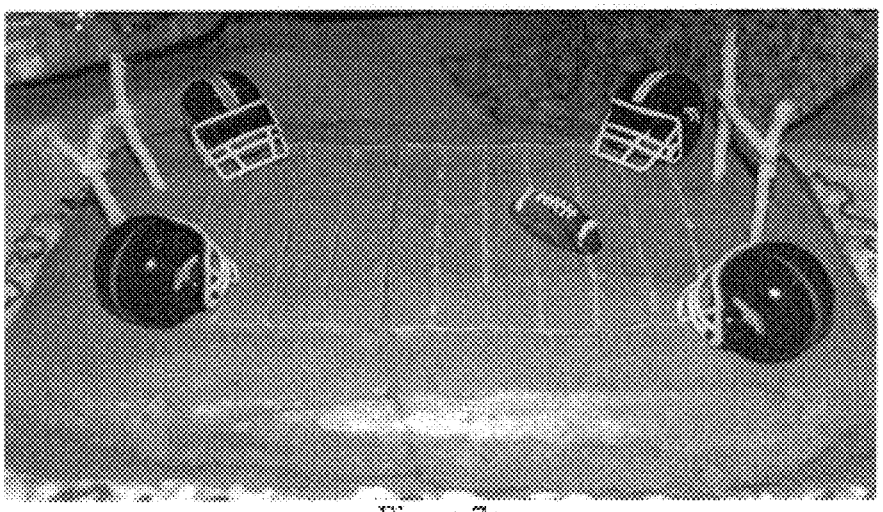
FIGS. 7*a–c* depicts multiple images (football and helmet) propagated within one background image (cake) which is yet another example of the inventive image propagation art display method.
Figure 7B:
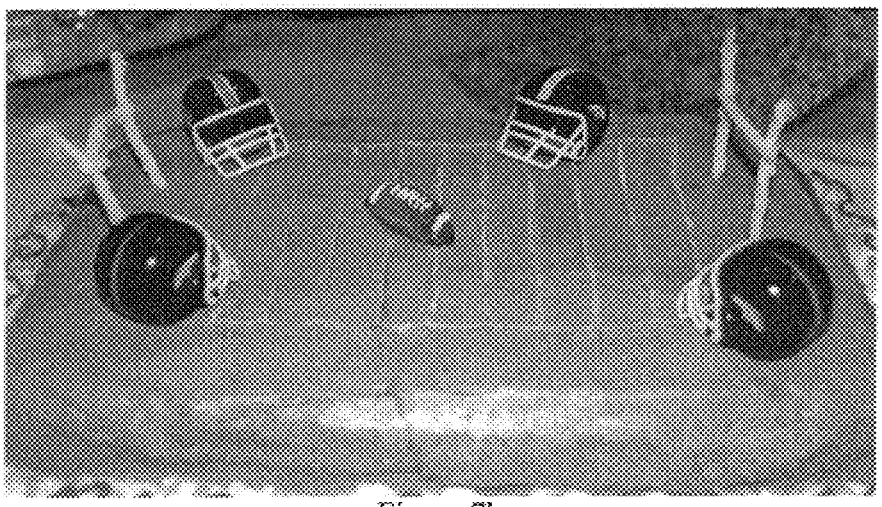
Figure 7C:
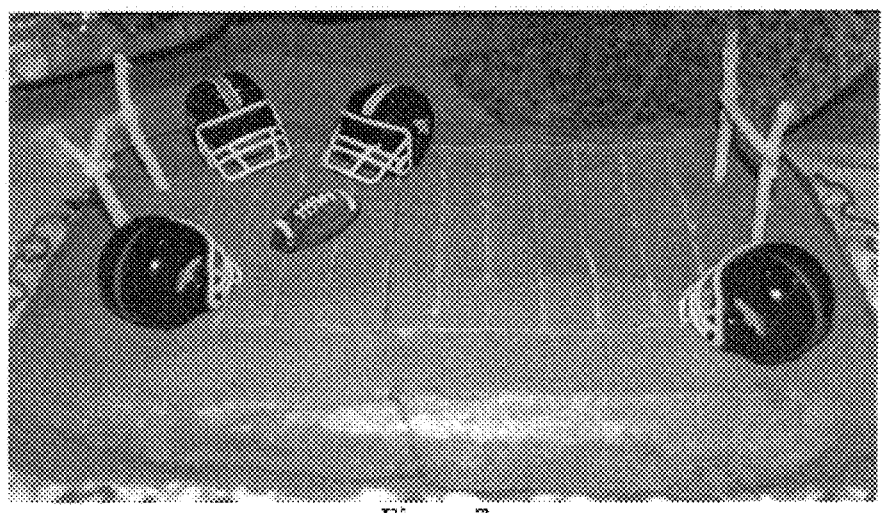

Both light phasing and image propagation may be performed in one of four distinct ways:

1. A single image transformed by image processing (e.g., moving a light source and altering shadows such as in FIGS. 1*a–c* and 3*a–b*);
2. A series of related images (e.g., a wave engulfing a lighthouse as in FIGS. 2*a–c* or person displayed at various ages with varying lighting, or the image pan of FIGS. 2*d–f*);
3. Two images—one background image and one foreground image (e.g. a woman walking down the stairs with a background image of the house and staircase, and a foreground image (the woman) that propagates in this background). The so-called foreground image can also be a virtual object that propagates within a background image (FIGS. 6*a–c*);
4. More than two images—two or more images propagated within one background, or one fixed image (FIGS. 7*a–c*).

Apparatus Description

Figure 4:
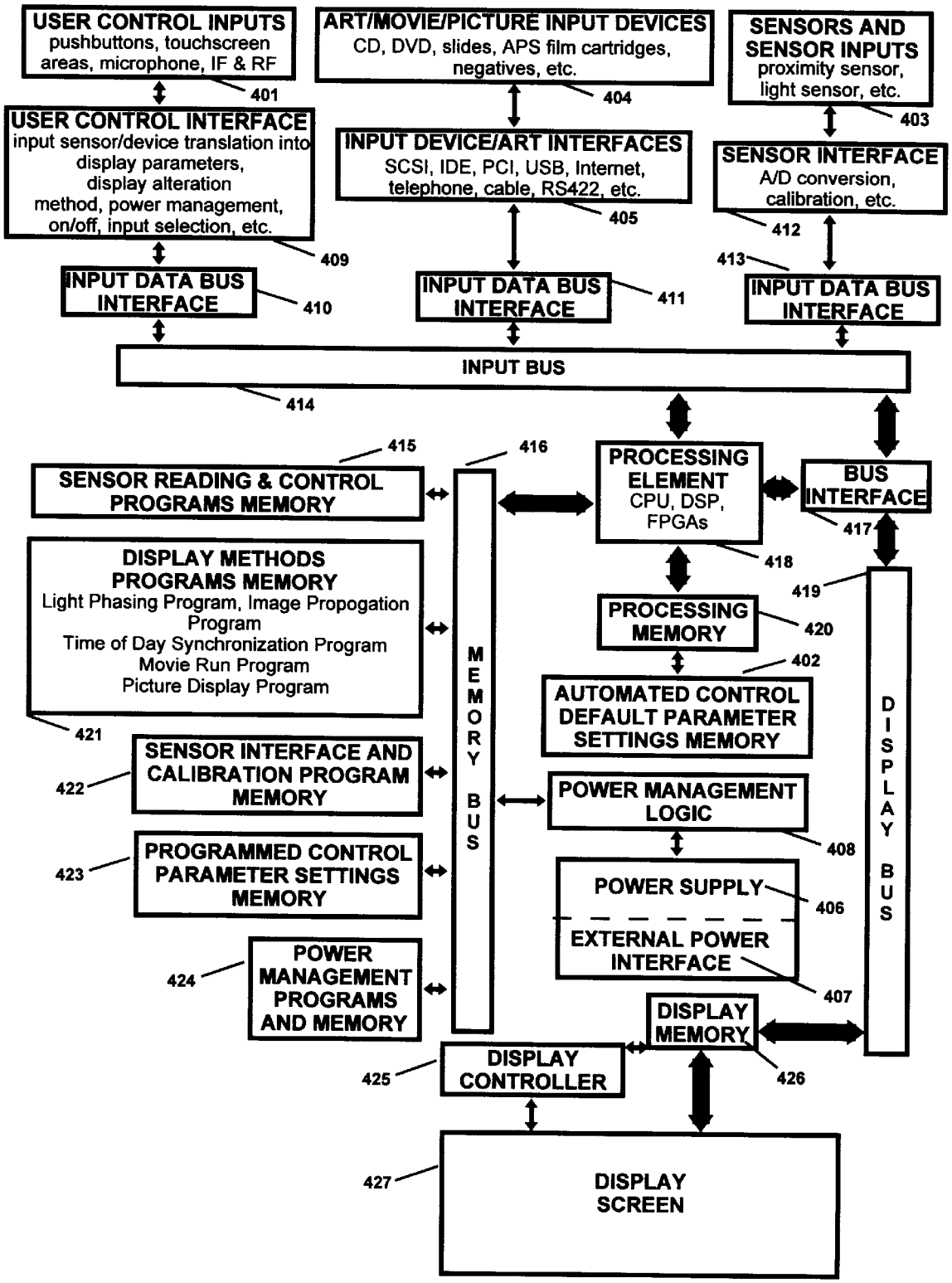
FIG. 4 shows a hardware block diagram of the invention.

The electronic and optical dynamic art form display may be implemented with the apparatus shown in FIG. 4. This apparatus is constructed as follows.

User control inputs (401) such as buttons, touchscreen areas, microphone and remote input devices (routed via RF and/or IF waves) are connected to user control interface (409). The user control interface is connected to an input bus (414) via input data bus interface (410).

Art/movie/picture input devices (404) such as compact disks (CDs), Digital Video Disks (DVDs) and APS cartridges (404) route data to the input bus (414) via input data bus interface (411). In this way, various media storage devices can download their data to the apparatus.

Sensors and sensor inputs (403) include local and/or remote light sensor(s), viewer proximity sensors, viewer directional or tracking sensors capable of tracking the direction or position of a person near the apparatus, a clock or clock input device for monitoring the time of day, ambient noise level sensors, and other environmental sensors.

The sensors (403) detect various environmental conditions and route the detected signals to the input bus (414) via sensor interface (412) and the input data bus interface (413). The sensor interface performs processing such as analog to digital (A/D) conversion and calibration on the detected signals. If a digital sensor (403) is utilized, such A/D conversion would be unnecessary.

A processing element (418) such as a central processing unit (CPU), digital signal processor (DSP), or field programmable gate array (FPGA), is connected to the input bus (414) directly and via a bus interface (417). A processing memory (420) is connected to processing element (418) and to an automated control default parameter settings memory (402).

Other memories are connected to processing element (418) via a memory bus (416). These memories include sensor reading and control programs memory (415), display methods programs memory (421), sensor interface and calibration program memory (422), programmed control parameter setting memory (423), and power management programs memory (424).

The memories (420),(402), (415), (421), (422), (423), (424) may be separately provided as shown or consolidated into one common memory device.

A display bus (419) connects bus interface (417) to display memory (426). A display controller (425) is connected to both display memory (426) and display screen (427) in order to perform display driving functions.

Figure 9:
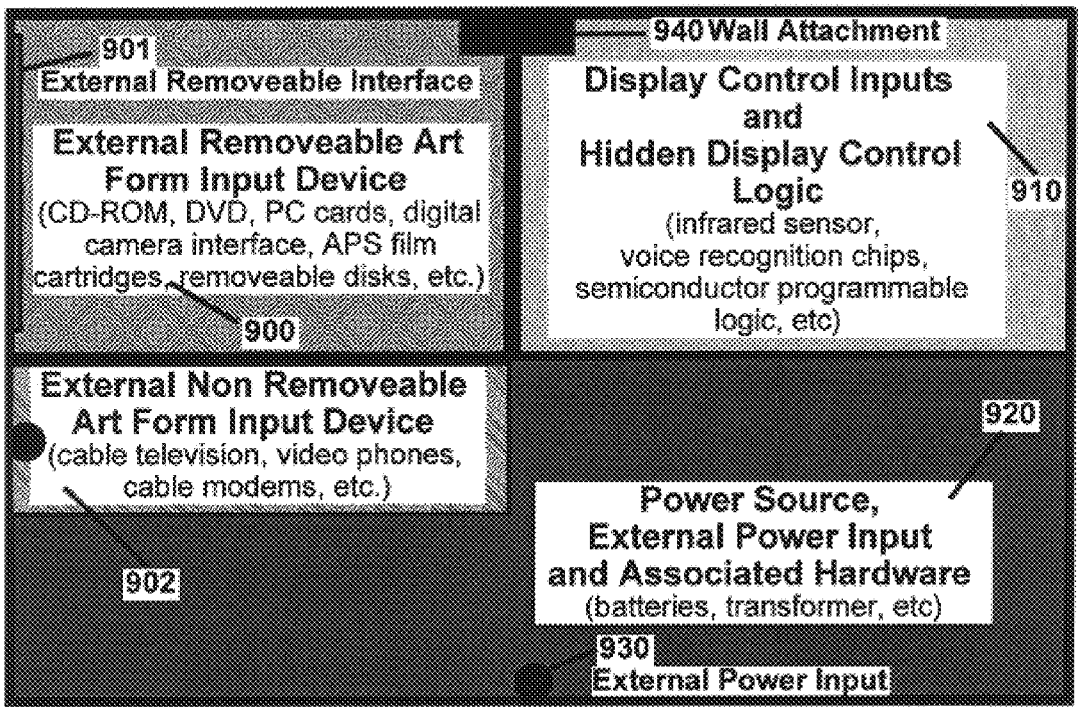
FIG. 9 shows the back of the preferred embodiment of the invention showing several major components.
Figure 10:
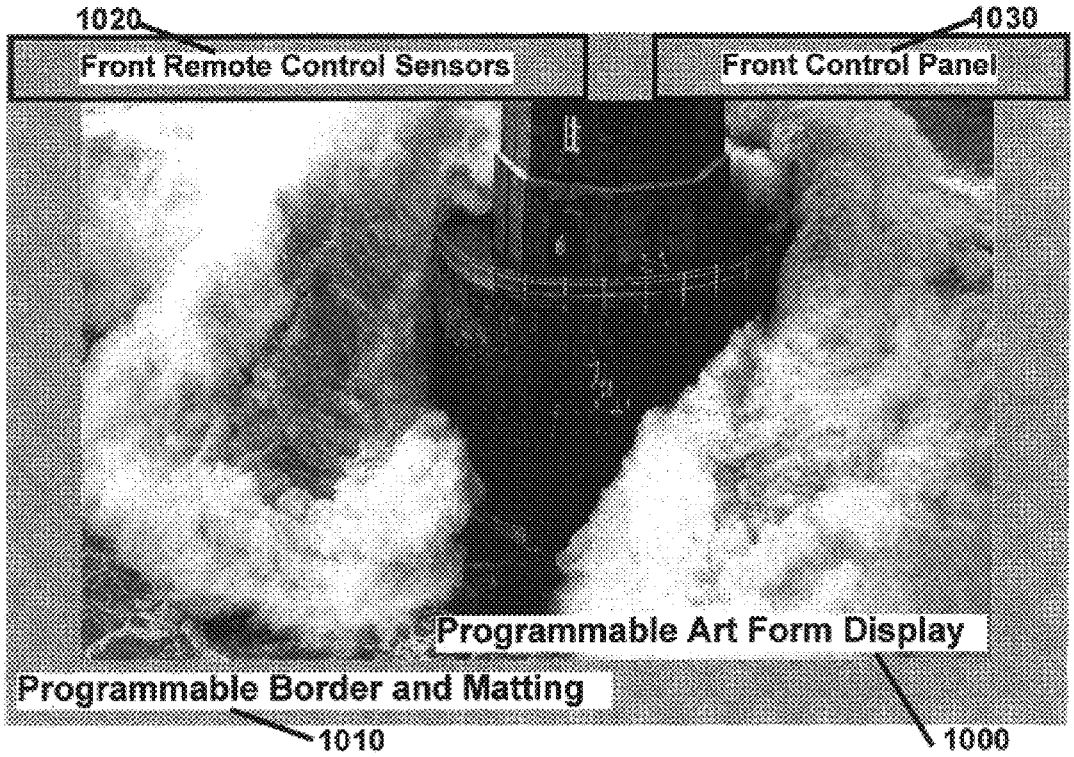
FIG. 10 shows the front of the preferred embodiment of the invention with several major components.

The display screen (427) is preferably a substantially flat display screen with hardware for mounting the display screen (427) to a wall. FIGS. 9–10 show the front and back sides, respectively, of the preferred hang-on-the-wall art form display apparatus. All of the components shown in FIG. 4 are preferably mounted within a common, substantially flat chassis thereby permitting the entire apparatus to be hung on the wall in the manner of an art form. Alternatively, the components can be mounted in a portable device thereby providing a portable art form display device. In addition, all components except those required for the display screen itself, e.g., the processing element, may be physically separated from the display and linked or operatively connected to the display via physical (e.g., wires) or wireless (e.g., IR or RF) means.

Using the apparatus shown in FIG. 4, art, pictures, movies, etc. to be displayed are input via physical art containers such as compact disks (CDs), Digital Video Disks (DVDs) and APS cartridges (404). The images that are processed by the invention into an art form display can also be input from non-physical storage devices (e.g., surveillance cameras, satellite links) via display interfaces such as the Internet, Universal Serial Bus (USB) and Small Computer Serial Interface (SCSI) (405) implemented through physical or wireless connections. Whether via physically removable art sources (404), non-physical art sources, physical and wireless input connections, and via electronic and optical transmission (405), inputs are routed through a standardized interface (405). These standardized interfaces (405) serve to assure that existing input media input and output formats and connections can be accommodated.

The input data bus interface (411) serves as a fixed connection to the display providing two functions: (a) a standard interface to display internals isolating new art form and new art input connections and formats from display internals and (b) providing a simple, standard method for accommodating new art, art media containers and input sources to be developed in the future. To accommodate a new media form, all that needs to be changed is the new media interface side of the input device/art interface (405). All other apparatus functions could remain unchanged.

User control inputs (401) and interface electronics (409) are also interfaced to the display internals via a standard interface (410). Sensor control inputs (403) and interface electronics (412) are also interfaced to the display internals via a standard interface (413). These standard interfaces (410,411,413) serve to isolate future art media, user and sensor technology interface changes to one side of a single hardware/software module, reducing the cost of incorporating future technology and prolonging the life span of the display.

A standard data input bus (414) is used to distribute display inputs to both a processing element (418) and a display bus interface (417). The display bus interface (417) allows the input data to be routed directly to the display screen (427) via a display bus (419) and display memory (426) in the case where the art input is in a form that does not require processing for displaying the art. The display bus (419) must have the capacity in bits per second, to accommodate all of the possible display options such as flipping through a CD of photos at a high rate. The display memory (426) should also have a similar capacity.

The sensor reading and control programs memory (415) are used by the processing element (418) to control the display according to the display methods programs memory (421). The sensor reading and control programs memory (415) tell the processing element (418) the sensor value parameters required by the display programs (421) in order to control the display in accordance with the sensor(s) selected and its current indications.

The sensor interface and calibration program memory (422) are used to calibrate the sensor readings for variations in temperature, dust levels on the sensor and other variables affecting the value of sensor readings. The sensor interface and calibration program memory (422) contents tell the processing element (418) how to alter and store the sensor readings in the sensor reading and control programs (415) memory. For example, the sensor readings when the display is first turned on may have a higher voltage reading for a given amount of ambient light than when the display and sensor have been on a while and are operating at higher temperatures. The sensor inputs (403) are routed through the sensor interfaces (412,413), the input bus (414) and the bus interface (413) to the processing element (418) which loads the sensor calibration programs (422) to perform periodic sensor calibrations and store the results in the sensor reading and control programs memory (415).

The programmed control parameter settings memory (423) stores all user and automated program settings delivered to it via the memory bus (416), the processing element (418), the bus interface (417), input bus (414) and user control input (401,409,410). The automated control default parameter settings memory (402) stores all factory default display settings for those cases where user input or sensor input is not received, either by malfunction of those input paths and devices, or lack of input from the user. The automated control default parameter settings memory (402) allow the display to operate without any user or sensor inputs and in the case of malfunctions. The automated control default parameter settings memory (402) can also contain on-screen display user instructions, and error and malfunction resolution procedures.

The power management programs and memory (424), and the power management logic (408) are used by the processing element (418) to control the power supply to conserve power when running on battery or other limited power supplies. The power management logic (408) controls the power supply for on/off operation and other processing element (418) power supply management inputs. The power supply (406) regulates, steps up or down and controls power delivery to all display components. The external power interface (407) provides connections and physical interfaces for external power connections such as 110 volt wall power and for internal or rear mounted display power supplies such as batteries.

The processing element (418) feeds the appropriately formatted art display data to the display memory (426) via the display bus (419). The display memory (426) and the display controller (425) provide for smooth display and refresh rates of the art display data from the processing element (418). The display screen (427) presents the display data from the display memory in a format applicable for the display technology, e.g., for Liquid Crystal Displays (LCDs), Transistor displays (TFT), etc.

Functional Description

Figure 5:
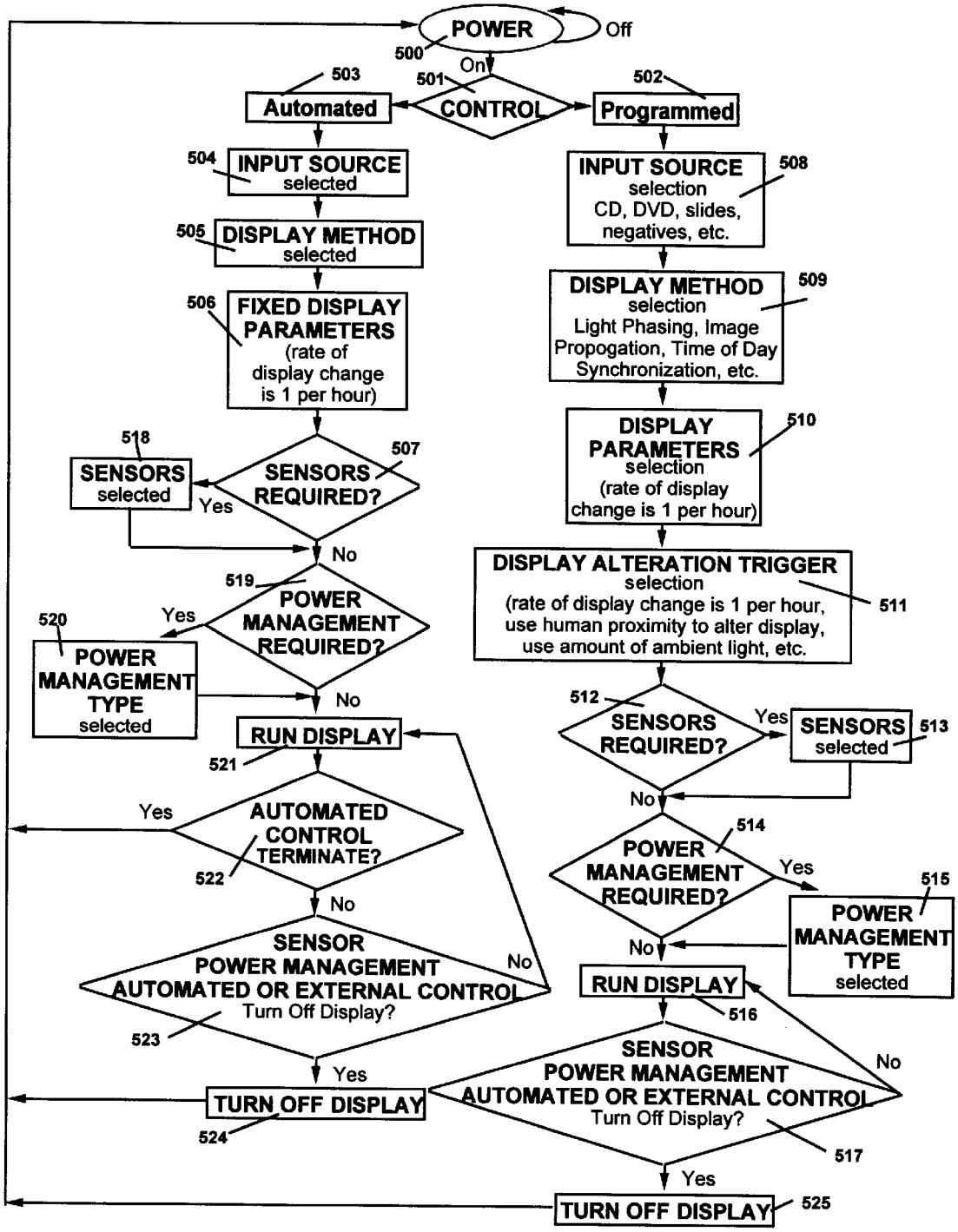
FIG. 5 shows a control flow chart of the invention.

The method of FIG. 5 utilizes the apparatus of FIG. 4. Specifically, the method of FIG. 5 and the display alteration programs are stored in display methods program memory (421). The method begins when the display is turned on initially by the user (500). After initial turn-on by the user, the display can be programmed to turn off or on according to sensor readings or factory settings. Once turned on, the user determines the type of control (501) desired. If automated control is desired (503), the art input source is selected (504) from the options available via (404) and (405). The display method is selected. Light phasing, image propagation (505) and the appropriate display parameters are entered (506), or a set of defaults (402) is agreed to via user input or after a set time has elapsed without a chosen selection. Depending upon the display parameters selected (506), a determination is made whether or not sensors are required (507).

If the user has selected time of day synchronization, then a time reference can be used. If the time of day synchronization is set such that only an internal clock, part of either (403), (424) or (418), or built in time tables (e.g., FIG. 8) are required, then no other external sensor is required. If time of day synchronization is set to synchronize with ambient light, then an ambient light sensor (physically or wireless remote or attached) input would be required. If the user has selected viewer proximity as a method of display control, then a proximity sensor will be required. If sensors are required, the necessary sensor suite is selected by the display (518). Depending upon user selections, power management may or may not be required (519,520).

The display now has all the required configuration information and display activation can begin (521). If automated control has been selected, checks are periodically made by running through the control chain (522,500,501,503,504, 505,506,507,519,521,522 . . . ) to determine whether operation should be terminated. If sensors or automated control requires a termination of display functions, the display turns itself off and waits for new power on and programming instructions. Power-on instructions may come periodically from the display control (421,418) in accordance with pre-programmed selection for periodic turn-on and turn-off. Using a time of day internal clock selection for turning the display on and off would be an example of automated turn on and turn off operation. The programmed chain of operations (502,508,509,510,511,512,513,514,515,516,517,525, 500,501,502 . . . ) is identical to the automated operation described with the exception of display alteration triggers (511). Here the more elaborate user-selectable operations can be set using any and all available sensors, display parameters and combinations of the two. This type of operation requires much more user input and is therefore given a separate operational path for those times and users when more complex operation is not desired.

Control Methods

Light phasing and image propagation are controlled via a number of user, sensor and automated source methodologies. User control methods for light phasing, image propagation and general display control include managing all sensor and automated control methods. The user can turn on or off sensor inputs or select which sensors to use. For example, the user can select the proximity sensor to increase the display change rate (either light phasing, image propagation or both) as the viewer approaches the display. The user can also select the change rate for automated operation. For example, the user can select once per hour for an image propagation of family photos to depict family members over the course of time.

Control over the complete set of display options can be via a number of user control inputs (401) such as voice command, wireless (e.g., IR and RF) remote control, physical touch inputs such as buttons, a touch screen, dials and knobs, and media input selections. Voice control includes the recognition of spoken commands such as "propagate further", "change lighting to early morning", "make it bright moon lighting", "move ahead twenty years", etc. User control can be exercised over all possible display options and controls, including sensor and automated control methods, even if some controls can be set as "factory default" settings requiring no user input for display operation.

Sensor source methods for light phasing, image propagation and general display control include environmental and external inputs used to trigger changes in the display. Inputs and sensors (403) envisioned for control include light sensors, humidity sensors, time-of-day clocks, viewer directional sensors, viewer proximity sensors, ambient noise level sensors, or any number of environmental and external inputs. Any and all sensors (403) can be located on the display, or the display can contain a sensor interface (412) to which remote sensors transmit their data. An IR port can be used for remote sensor interfacing and data input. For example, a remote light sensor senses the ambient light levels outside a home, transmit the levels to the display for light phasing according to outside, rather than display location, light phasing. The light sensor (403) would therefore not be fooled by false light readings for a display location where the light levels do not match the desired light phasing or image propagation timelines.

A viewer proximity sensor (403) can also be used by the processing element (418) and display methods programs memory (421) to vary the light phasing, image propagation and display resolution based on the distance to the viewer. As people are near the display, the image is propagated at a certain rate and when people are not near the display, the image is not propagated. The display can be turned on or off via light or viewer proximity. If no ambient light is detected, such as in a home at midnight with no lights on, or there is no viewer detected within a given distance, say 25 feet, the display is turned off. A viewer directional sensor (403) can be used to pan or rotate the image or objects displayed with the viewer's movement. An ambient noise level sensor (403) can be used to vary the display by increasing the rate of change as noise levels rise and decreasing the rates of change as noise levels drop. All sensor parameters, such as sensitivity levels, on/off, linearity or non-linearity of response values, etc. can be controlled via user control input or left for automated control.

Sensors can be used in combination to control light phasing and image propagation. For example, an ambient light sensor can be used in conjunction with a proximity sensor to alter the displayed art in synchronization with light of day only when a viewer is within viewing distance. Such combinations of sensors can also be automatically set by the apparatus power management (424) to save power, particularly when running on internal battery power.

Automated source methods for light phasing, image propagation and general display control include time of day synchronization, moon phases, propagation rates of time such as change every second, every hour, every week, every month and utilization of image data from input media and etc. For example, APS film cartridge data could be used to display an image on an anniversary date or to display vacation pictures on the anniversary of when they were taken.

Time of day synchronization is defined herein as the method of altering the display of art or objects whereby a physical characteristics of an object or objects depicted in the display is altered according to the passage of time including time of day, time of the week, time of the month, season of the year and phases of the moon. The time of day may be local time or remote time. For example, the time of day at another point on earth can be used to simulate Tokyo, Japan time-of-day-lighting of a Tokyo landmark art form displayed on an apparatus that is hung on a wall in New York, USA.

A table, such as shown in FIG. 8, relating sun position and lighting values to times of day for local and other positions on earth is stored in the programmed control parameter settings memory (423) or other memory device of the apparatus display to control the light phasing. Built-in 24 hour timers, part of either (403), (424) or (418), and tables can be used to provide the automated rates of change for the display, whether light phasing or image propagation.

Time of day synchronization display options include depicting the skyline during any time in history or the future from any view point on earth and altering the view in synchronization with the time of day and day of the year. The variation of the displayed object using time of day synchronization includes the display a flower closed in the morning, opening during the course of the morning, fully open at noon, closing during the afternoon, and fully closed at evening time.

Another example of time of day synchronization used in conjunction with light phasing is the display of a landscape scene altered over display intervals to show the scene during sunrise in the morning, strong overhead, little or no shadows during noon time, and sunset lighting at sunset time of day.

FIGS. 3*a–b* depict a time of day synchronization in conjunction with light phasing. The image is altered by the display's built-in control and processing functionality to exactly match the time of day. Automated display control methods are accomplished in conjunction with a number of different environmental and external input sensors. The time of day can be received from atomic clock transmissions through the air or via an external interface input (412) which may include a connection to the Internet. All automated source methods of display control can be controlled via user control input or left for built in, program and timer set, automated control. Whether by user input, sensor input, automated control or any combination of the these three, more conventional changing displays are also provided such as displaying several still pictures over the course of time where the selections and display times are viewer choices or provided at random, sequentially or in some other invention chosen manner. Entire photo or art collections can be displayed over the course of time as the display cycles through the available art and photo choices at a rate selected by the viewer or programmed by the viewer at some previous time. An entire art museum collection can be displayed in this manner over a time interval selected by the viewer. Several art works, pictures, movies or combinations of all three can be displayed simultaneously as selected by the viewer.

The entire display can be configured and programmed by the user (FIG. 5) or through built in functionality (402) to provide a wide range of control options: viewer proximity (e.g., as a person or persons come within a specified distance of the display, the display alters itself in some manner such as brightness, display content or framing); human voice commands; optical (including IR) and RF remote control signals; user programmable inputs such as keys and touch screen controls; and built-in automated control such as a predetermined display change rate interval.

Human viewer proximity is defined herein as the method of altering the display of art or objects whereby any aspect of the display is altered based upon the proximity of people to the display. The display can be programmed to turn on when people are within a defined viewing distance. The viewing distance can be set depending upon the display size. For example, if the display is a 40 inch hang-on-the-wall display, the proximity control can be set such that if people are detected to be within 10 feet, the display will turn on. For a small display, say 10 inches, the proximity control can be set to alter the display when people are detected within 2 feet.

Other display control methods that may be utilized in conjunction with the display control methods disclosed herein include: voice, IR and radio signal remote controls, user accessible push buttons or touch screen controls, and automated, built in default controls such as fixed image propagation rates (e.g. once per hour).

The human proximity control, as well as other display controls can be set to control the innovative display methods. For example, the display image can be propagated only when there are people within a defined proximity distance. Noise levels, amount of ambient light, time of day, etc. are all inputs that can be used to propagate the displayed art at user defined or automatic rates.

As shown in FIGS. 9 and 10, the display controls (910) and (1030) provide a vast number of viewing options including the selection of the programmable border of the display as further described below. The controls can be accessed via a front panel (1030) which opens to reveal the controls in the case of a non programmable display border. For remote control, the display control input sensors (1020) are visible from the front. Such sensors can include an IR, radio frequency, voice or other type of interface/signal converter.

In the case of a completely programmable border display, no controls or sensor input are visible from the front. In this case, control input is via remote control that does not require a direct line of site, such as voice commands or RF, with the input sensors located on the back and side of the display (910). The actual display control logic is hidden behind the display (910). The display logic is composed of programmable semiconductors and discrete logic hardware. The display itself would depict the options selected for a set time period on the order of a few seconds. The controls can also be accessed via the display screen (1000) itself via touch screen inputs. In this case, the viewers can touch a given area, (e.g., the far right comer) of the display, bring up a menu of art, picture and movie viewing and selection options, and touch the screen at the regions allocated as the control inputs.

The invention accepts a wide variety of input media or electronic and optical connections as the source of art, pictures or movies to be displayed (404). The external input device interface (901) options provide a connection to the source of the art, pictures and movies. A standard interface (901) to the display and control logic, such as the small computer serial interface (SCSI), IDE, RS-422, etc., provides for plugging in electronic and optical art, picture and movie storage media in industry standard formats such as CD-ROM drives, DVD drives, flash memory cards, digital cameras, removable disk drives, tape drives, etc (900,405). The invention can be equipped with any one of these standard input devices, allowing viewers the option of media and display sources. Viewers insert and remove the media of their choice from the appropriate device at the side and slightly behind the front of the display. Another interface provided is for input from non-removable art form sources (902) such as cameras, satellites, cellular telephones, pagers, personal communication systems (PCS), cable television, television decoders, computer networks, video phones and household/computer networks. This type of interface can also be swapped in and out to accommodate various existing, emerging and future art form sources.

The power supply (406,920) can be internal or external. Internal power supply options are preferred and include batteries of various technologies, wind up electrical generators, and various types of gravity lowering of weight methods (e.g., Cuckoo clock) of generating electricity. External power sources require an interface (407,930) which can accept power from any number of sources such as wall current transformers, solar cell output, etc. The power supply will provide power control and management functions such as power save functions including display dimming, sleep mode and on off functions (408). These power functions will be viewer selectable through the display controls.

The entire invention has the weight, volume and power requirements to be hung on the wall to act as an electronic and optical, programmable alternative to current-day, hang-on-the-wall art and photographs, or can be carried in one's pocket as an alternative to current photo albums and art displays. All non-display components of the invention fit behind and on the side of the display so that the entire invention can be attached to the wall via standard wall hanger hardware (940).

Referring to FIG. 10, the display, (1000) and (1010), is a semiconductor, electronic and optical display such as an active or passive matrix LCD, an array of light emitting diodes (LEDs), transistor or other type of thin display (e.g., TFT) requiring approximately two inches in depth. The display can have a fixed or a programmable border (1010). With a fixed border, the display is preferably mounted inside a frame made of a material such as wood or plastic.

In the case of a programmable border (1010), the display itself has no frame and the display area fills the entire width of the invention. The viewer can program the border of the display to simulate any number of framing and matting options. The programmable border (1010) can be selected by the viewer to be a certain number of inches or centimeters around the edge of the display. The border texture parameters can be defined by the user to be a wood texture, metal or any number of selectable texture simulations. Color options for the border include any combination of black and white, gray scale, and color, and texture maps. The programmable border (1010) may also be composed of several borders of different sizes, colors and texture combinations to simulate a frame with one or more mattes. Furthermore, the light phasing and image propagation methods may be applied to alter the programmable border (1010).

This invention provides the following exclusive art, picture and movie display features: light phasing, image propagation, time of day synchronization and combinations thereof. The types of art, pictures and movies (1000) that can be displayed by the invention include new options only possible with this invention. Movies can be displayed in real time at motion picture frame rates as well as frame by frame, in reverse or in any other manner currently offered by Video Players (fast forward, fast reverse, still, etc.). Besides the typical unchanging display of art, picture and movies, an endless variety of changing displays are possible with the invention. Art, picture and movies displayed can be animated to change over the course of time according to the inventive control methods described above.

This invention removes major restrictions from existing art, picture and movie displays and allows new art, picture and movie forms by providing innovative display alterations: light phasing, image propagation, time of day synchronization and environmental input. Displaying a woman coming down a flight of stairs one stair at a time or the lighting within the picture changing during the course of a day are some examples of the new types of changing art displays made possible by this invention. Even non-changing art, pictures and movies can be displayed in a changing manner, for example, by rotating the pictures displayed from one family picture to another.

Unlike present day non-electronic and electronic and optical art, picture and movie displays the display is not limited to one selection that never changes, with a frame and matting that can not be changed. The entire invention can be hung on the wall, or carried in one's pocket. It has the size, weight and volume characteristics of present day on the wall picture or personal assistant displays, and provides for viewer or automatic control over what is displayed, as well as over the frame or border of the display. At an estimated consumer bearable price, this invention will provide millions with a flexible, adaptive art, picture and movie display that never grows out of date.

The use of any or all of the unique display methods of light phasing, image propagation, time of day synchronization and any combination of these with flat, electronic and optical wall and portable, hand-held displays completes the innovation in that the entire package forms a product for sale and consumption.

All components except the display itself, could be physically distant from the display and not even a part of the display, linked via physical connection (e.g., wires) or linked via wireless connections (e.g., IR, RF). For example, the processing element could be a PC, transmitting the contents of a CD, Internet or any other art source data to the input data bus interface (411), directly to the display controller (426), or to any portion of the display. All of the programmable user functions could be located on a desk unit, transmitting their user selections to the memory bus (416).

Almost any device can serve as an art input source by being linked to the display components or the display itself via wireless connections. As long as the art source transmits the art data in a format understandable by the display control logic, the display can present the art data on the screen. The display logic, e.g., the processing element and display methods program memory, can all be programmed via software to alter their functionality to accommodate new art forms and display options. Display functionality updating can be accomplished via physical or wireless input through the input bus interfaces (410,411,413) to upload new programs, sensor settings, time of day synchronization tables, etc.

The invention being thus described, it will be obvious that the same may be varied in many ways. Such variations are not to be regarded as departure from the spirit and scope of the invention, and all such modifications as would as would be obvious to one skilled in the art are intended to be included within the scope of the following claims.

What is claimed is:

1. A wall-mountable or portable dynamic art form display apparatus, comprising:

at least one art source operatively connected to said display device and supplying at least one art image;

a substantially planar display device displaying the art image; and an image controlling device operatively connected to said display device and said art source, said image controlling device altering light phasing in the art image; wherein, when altering light phasing in the art image, said image controlling device alters the appearance of the displayed art image to simulate a viewer-noticeable changed lighting condition of an object depicted as part of the art image.

2. The dynamic art form display apparatus according to claim 1, wherein said image controlling device alters light phasing in the art image by simulating a change in at least one of lighting angle, intensity and type.

3. The dynamic art form display apparatus according to claim 2, wherein said image controlling device further propagates at least one object in the art image to generate a propagated art image to depict a change in at least one physical characteristic of at least one object in the art image.

4. The dynamic art form display apparatus according to claim 2, wherein said image controlling device alters light phasing to simulate the effect of moving shadows as the sun moves from East to West.

5. The dynamic art form display apparatus according to claim 2, wherein said image controlling device alters light phasing to alter the appearance of at least one displayed image or image object by changing the light type, light types including sky lighting of direct and indirect sun and moon light at various angles and intensities.

6. The dynamic art form display apparatus according to claim 1, wherein said image controlling device alters light phasing in the art image without requiring user control inputs.

7. The wall-mountable dynamic art form display apparatus according to claim 1, further comprising an automated control device operatively connected to the display apparatus that operates the display without requiring user inputs.

8. The dynamic art form display apparatus according to claim 1, wherein said dynamic art form apparatus further comprises an environmental sensor operatively connected to said image controlling device and detecting an environmental condition, said environmental sensor including one or more of the following:

a proximity sensor detecting physical proximity of a viewer, a noise sensor detecting an ambient sound level, a light sensor detecting an ambient light level, a humidity sensor detecting ambient humidity, a tracking device tracking a physical location of a viewer, or a time sensor sensing a time of day.

9. The dynamic art form display apparatus according to claim 1, wherein said dynamic art form apparatus further comprises an environmental sensor operatively connected to said image controlling device and detecting an ambient environmental condition around the apparatus, said image controlling device altering light phasing in relation to the environmental condition detected by said environmental sensor.

10. The dynamic art form display apparatus according to claim 9, wherein said environmental sensor is mounted to the display apparatus or at a location remote to the apparatus.

11. The dynamic art form display apparatus according to claim 9, further comprising:

a remote sensor interface device operatively connected to said image controlling device, wherein said environmental sensor is mounted at a location remote to the apparatus, detects an ambient condition around said environmental sensor, and sends a sensor value signal to said remote sensor interface device, said remote sensor interface device routing the sensor value signal from said environmental sensor to said image controlling device.

12. The dynamic art form display apparatus according to claim 1, wherein said image controlling device alters light phasing in the art image by manipulating pixels within the art image.

13. The dynamic art form display apparatus according to claim 1, wherein said image controlling device alters light phasing in the art form by controlling the routing of a series of at least two art images from said art source to said display device.

14. The dynamic art form display apparatus according to claim 1, further comprising:

a wall-mounting device attached to a back side of the apparatus that permits the apparatus to be mounted to a wall.

15. The dynamic art form display apparatus according to claim 1, wherein the apparatus is a portable device.

16. The dynamic art form display apparatus according to claim 1, wherein said display apparatus further comprises an environmental sensor operatively connected to said image controlling device and detecting an environmental condition, said image controlling device altering light phasing in the art image in relation to the environmental condition detected by said environmental sensor and in relation to a time reference.

17. The dynamic art form display apparatus according to claim 1, wherein said image controlling device alters light phasing in the art image in relation to a time reference, wherein the time reference is a clock signal in synchronism with an actual time of day.

18. The dynamic art form display apparatus according to claim 17, wherein the time reference is of an actual time of day at a location distinct from a location of the dynamic art form display apparatus.

19. The dynamic art form display apparatus according to claim 1, wherein said image controlling device alters the light phasing at a rate related to the actual time of day, week, month, year or other time unit.

20. The dynamic art form display apparatus according to claim 1, further comprising:

a time reference table operatively connected to said image controlling device, said table storing a time reference of a relationship between actual time of day and simulated lighting conditions;

wherein said image controlling device accesses said time reference table and thereby alters the light phasing in the art image to simulate different lighting conditions.

21. The dynamic art form display apparatus according to claim 1, wherein said image controlling device also propagates at least one object in the art image to generate a propagated art image to depict a change in at least one physical characteristic of at least one object in the art image, said display device displaying the art image and the propagated art image.

22. The dynamic art form display apparatus according to claim 21, wherein said image controlling device propagates at least one object in the art image to depict a change in at least one size, position, shape, color, apparent age, viewing angle, and rotation angle of at least one object within the art image.

23. The dynamic art form display apparatus according to claim 22, wherein the object is a person and said image controlling device depicts aging of the person via image propagation.

24. The dynamic art form display apparatus according to claim 22, wherein the object is a geographical location and said image controlling device depicts changes to the geographical location over time.

25. The wall-mountable dynamic art form display apparatus according to claim 21, further comprising an automated control device operatively connected to the display apparatus that operates the display without requiring user inputs.

26. The dynamic art form display apparatus according to claim 21, wherein said dynamic art form apparatus further comprises an environmental sensor operatively connected to said image controlling device and detecting an environmental condition, said environmental sensor including one or more of the following:

a proximity sensor detecting physical proximity of a viewer, a noise sensor detecting an ambient sound level, a light sensor detecting an ambient light level, a humidity sensor detecting ambient humidity, a tracking device tracking a physical location of a viewer, or a time sensor sensing a time of day.

27. The dynamic art form display apparatus according to claim 21, wherein said dynamic art form apparatus further comprises an environmental sensor operatively connected to said image controlling device and detecting an ambient environmental condition around the apparatus, said image controlling device propagating the art image in relation to the environmental condition detected by said environmental sensor.

28. The dynamic art form display apparatus according to claim 27, wherein said environmental sensor is mounted to said display apparatus or at a location remote to the apparatus.

29. The dynamic art form display apparatus according to claim 27, further comprising:

a remote sensor interface device operatively connected to said image controlling device, wherein said environmental sensor is mounted at a location remote to the apparatus, detects an ambient condition around said environmental sensor, and sends a sensor value signal to said remote sensor interface device, said remote interface sensor device routing the sensor value signal from said environmental sensor to said image processing device.

30. The dynamic art form display apparatus according to claim 21, wherein said image controlling device propagates the art image by manipulating pixels within the art image.

31. The dynamic art form display apparatus according to claim 21, wherein said image controlling device propagates the art image by controlling the routing of a series of at least two art images from said art source to said display device.

32. The dynamic art form display apparatus according to claim 21, further comprising a wall-mounting device attached to a back side of the apparatus that permits the apparatus to be mounted to a wall.

33. The dynamic art form display apparatus according to claim 21, wherein the apparatus is a portable device.

34. The dynamic art form display apparatus according to claim 21, wherein said display apparatus further comprises an environmental sensor operatively connected to said image controlling device and detecting an environmental condition, said image controlling device propagating the art image in relation to the environmental condition detected by said environmental sensor and in relation to a time reference.

35. The dynamic art form display apparatus according to claim 34, wherein the time reference is a clock signal in synchronism with an actual time of day.

36. The dynamic art form display apparatus according to claim 35, wherein the actual time of day is an actual time of day at a location distinct from a location of the dynamic art form display apparatus.

37. The dynamic art form display apparatus according to claim 34, wherein said image controlling device propagates the art image at a rate related to an actual time of day, week, month, year or other time unit.

38. The dynamic art form display apparatus according to claim 34, further comprising:

a time reference table operatively connected to said image processing device, said table storing a time reference of a relationship between an actual time of day and an image propagation pattern;

wherein said image controlling device accesses said time reference table and thereby propagates the art image in accordance with the image propagation pattern.

39. The dynamic art form display apparatus according to claim 1, further comprising:

a programmable border area surrounding a viewing area of said display device.

40. The dynamic art form display apparatus according to claim 39, further comprising:

an environmental sensor operatively connected to said image controlling device, said environmental sensor sensing an environmental condition;

said image controlling device altering the art image such that the art form changes according to a change in an environmental condition sensed by said environmental sensor.

41. The dynamic art form display apparatus according to claim 40, said image controlling device altering light phasing in the art image in relation to the environmental condition detected by said environmental sensor.

42. The dynamic art form display apparatus according to claim 41, wherein the light phase alteration includes altering lighting angle, intensity or type.

43. The dynamic art form display apparatus according to claim 40, wherein said environmental sensor includes one or more of the following:

a proximity sensor detecting physical proximity of a viewer, a noise sensor detecting an ambient sound level, a light sensor detecting an ambient light level, a humidity sensor detecting ambient humidity, a tracking device tracking a physical location of a viewer, or a time sensor sensing a time of day.

44. The dynamic art form display apparatus according to claim 40, said image controlling device propagating the art image in relation to the environmental condition detected by said environmental sensor.

45. The dynamic art form display apparatus according to claim 44, wherein, when propagating, said image controlling device depicts a change in at least one of size, position, shape, color, apparent age, viewing angle, and rotation angle of at least one object within the art image.

46. The dynamic art form display apparatus according to claim 40, further comprising a sensor calibrator operatively connected to said environmental sensor.

47. The dynamic art form display apparatus according to claim 39, further comprising an automated control device operatively connected to the display apparatus that operates the display without requiring user inputs.

48. The dynamic art form display apparatus according to claim 1, wherein said art source is a removable art form input device.

49. The dynamic art form display apparatus according to claim 1, wherein said art source is a non-removable art form input device.

50. The dynamic art form display apparatus according to claim 1, further comprising:

a user control input device operatively connected to the apparatus permitting a user to control the apparatus.

51. The dynamic art form display apparatus according to claim 50, said image controlling device altering the art image to generate a processed art image in relation to user inputs from said user control input device.

52. The dynamic art form display apparatus according to claim 51, wherein said user control input device includes one or more of the following:

voice command input device, push buttons input device, dial input device, alphanumeric key input device, touch screen input device, or wireless remote control input device.

53. The dynamic art form display apparatus according to claim 51, wherein said user input device is physically connected to the apparatus.

54. The dynamic art form display apparatus according to claim 51, wherein said user input device is at a location remote to the apparatus and sends a user input signal to said wall-mountable dynamic art form display apparatus.

55. The dynamic art form display apparatus according to claim 51, further comprising:

a remote user interface device operatively connected to said image controlling device, wherein said user input device is a remote user input device at a location remote to the apparatus, said remote user interface device routing the user input signal from said remote user input device to said image controlling device.

56. The dynamic art form display apparatus according to claim 1, wherein said image controlling device alters light phasing in the art image by manipulating pixels within the art image.

57. The dynamic art form display apparatus according to claim 1, wherein said image controlling device alters light phasing in the art image by controlling the routing of a series of at least two art images from said art source to said display device.

* * * * *

UNITED STATES PATENT AND TRADEMARK OFFICE

CERTIFICATE OF CORRECTION

PATENT NO. : 6,339,429 B1
DATED : January 15, 2002
INVENTOR(S) : Klaus Schug

It is certified that error appears in the above-identified patent and that said Letters Patent is hereby corrected as shown below:

Title page,
Item [73], Assignee, currently listed as "MZMZ Technology Innovations LLC," should be changed to -- MCMZ Technology Innovations LLC --.

Signed and Sealed this

Fourth Day of March, 2003

JAMES E. ROGAN
*Director of the United States Patent and Trademark Office*